United States Patent [19]

Yamaguchi et al.

[11] Patent Number: 4,668,409

[45] Date of Patent: May 26, 1987

[54] LUBRICATING OIL COMPOSITIONS CONTAINING OVERBASED CALCIUM SULFONATES AND METAL SALTS OF ALKYL CATECHOL DITHIOPHOSPHORIC ACID

[75] Inventors: Elaine S. Yamaguchi, El Cerrito; Thomas V. Liston, San Rafael, both of Calif.

[73] Assignee: Chevron Research Company, San Francisco, Calif.

[21] Appl. No.: 537,627

[22] Filed: Sep. 30, 1983

[51] Int. Cl.[4] ..... C10M 137/10

[52] U.S. Cl. ..... 252/32.7 E; 252/33.4; 252/46.7

[58] Field of Search ..... 252/32.7 E, 46.7, 33.4

[56] References Cited

U.S. PATENT DOCUMENTS

| | | | |
|---|---|---|---|
| 2,410,650 | 11/1946 | Giammaria | 252/33.6 |
| 2,480,673 | 8/1949 | Reiff et al. | 252/32.7 E |
| 2,506,570 | 5/1950 | Andress | 252/32.7 |
| 2,540,084 | 2/1951 | Asseff | 260/429 |
| 3,327,024 | 6/1967 | De Young et al. | 252/32.7 E X |
| 3,428,662 | 2/1969 | Millendorf et al. | 260/429.9 |
| 3,515,712 | 6/1970 | Goldsmith | 260/139 |
| 3,687,848 | 8/1972 | Colclough et al. | 252/32.7 E |
| 4,010,107 | 3/1977 | Rothert | 252/32.7 E |
| 4,085,053 | 4/1978 | Caspari | 252/32.7 E |
| 4,101,428 | 7/1978 | Crawford | 252/32.7 E |
| 4,113,634 | 9/1978 | Sabol et al. | 252/32.7 E |
| 4,443,360 | 4/1984 | Yamaguchi et al. | 252/46.7 |
| 4,450,096 | 5/1984 | Horodysky | 252/32.7 |

*Primary Examiner*—Jacqueline V. Howard

*Attorney, Agent, or Firm*—S. R. LaPaglia; R. C. Gaffney; G. F. Swiss

[57] ABSTRACT

The anti-wear properties of lubricating oil compositions containing overbased calcium sulfonate are improved when a metal salt of an alkyl catechol ester of dithiophosphoric acid is added to the oil. Oil compositions containing this combination are useful as crankcase lubricants.

9 Claims, No Drawings

LUBRICATING OIL COMPOSITIONS CONTAINING OVERBASED CALCIUM SULFONATES AND METAL SALTS OF ALKYL CATECHOL DITHIOPHOSPHORIC ACID

BACKGROUND OF THE INVENTION

1. Field of the Invention

This invention relates to a lubricating oil composition which reduces wear between relatively moving surfaces while providing protection, concomitantly from sludge formation and corrosion.

2. Description of the Prior Art

A balanced formulated lubricating oil for use in an internal combustion engine normally contains additives which will protect against wear, act as antioxidants, corrosion inhibitors and detergent-dispersants.

In the past many hydrocarbyl dithiophosphate compounds have been employed as additives in lubricant compositions primarily to reduce wear and to act as antioxidants. Of the many compounds employed, perhaps the best known are zinc salts of O,O'-dihydrocarbyl dithiophosphoric acids.

Also, since lubricating oils tend to deteriorate under conditions of use in the present day automobile engine, with the attendant formation of sludge, lacquer and resinous materials, it is common to add agents which are known in the art as detergents, dispersants or detergent-dispersants. Overbased metal hydrocarbyl sulfonates are particularly useful in this respect. These agents are believed to be effective because they provide alkalinity capable of neutralizing strong organic and inorganic acids and are capable of dispersing deposits and deposit precursors into the oil phase.

It has been found, however, that lubricating oils containing overbased calcium hydrocarbyl sulfonates tend to offset the effectiveness of the normal metal salts of dihydrocarbyl dithiophosphoric acids to provide sufficient wear protection in the internal combustion engine of an automobile. This is particularly true in high calcium ash formulations containing from about 1% to 2.5% by weight ash content. This is an especially bad situation at this time since automobile manufacturers are seeking to use lower levels of metal salts of dihydrocarbyl dithiophosphoric acids in lubricating oils in order to protect against deterioration in performance of the emissions control system—both catalyst poisoning and oxygen sensor contamination are involved.

SUMMARY OF THE INVENTION

It has now been found that this detrimental effect of the overbased calcium hydrocarbyl sulfonates on wear of metal parts in the internal combustion engine can be overcome by adding to a lubricating oil containing these materials an effective amount to reduce wear of a metal salt of an alkyl catechol dithiophosphoric acid ester of the formula:

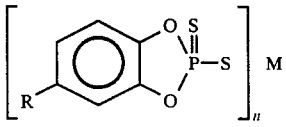

wherein R is alkyl containing 10 to 18 carbon atoms or mixtures thereof, M is an alkali or alkaline earth metal or transition metal and n corresponds to the valence of the metal M.

DETAILED DESCRIPTION

The metal salts of the Formula I of this invention may be prepared by the neutralization of the alkyl catechol esters of dithiophosphoric acid of the formula II

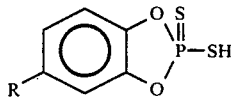

II or mixture thereof, wherein R is defined above, with a basic metal compound such as an alkali or alkaline earth metal or transition metal hydroxide, carbonate or oxide and preferably the metal is selected from the groups IIB, IIIB, IVB, VIB or VIII of the Periodic System of Elements and, in particular, zinc.

The reaction may be carried out at a temperature of between about 25° C. and 180° C. with an amount of basic metal compound between the amount stoichiometrically necessary to neutralize the dithiophosphoric acid and twice said stoichiometric amount, and preferably between 1.1 and 1.5 times the stoichiometric amount.

The metal salt so formed may also be converted to a different metal salt by double decomposition thereof with a metal salt such as a chloride or sulfate. For example, the sodium salt formed in neutralization may be converted to the zinc salt by reaction thereof with zinc sulfate. The reaction is preferably carried out in the presence of a solvent, e.g. benzene or toluene and under nitrogen. The salt may be isolated from the reaction product mixture by conventional techniques such as by extraction.

The alkyl catechol esters of dithiophosphoric acid of the Formula II

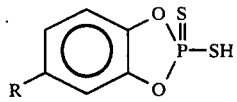

II or mixtures thereof, wherein R is defined above, can be prepared by the action of phosphorus pentasulfide on an alkyl catechol or mixture of alkyl catechols of the Formula III

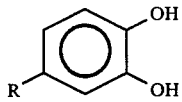

III wherein R is defined above, with an amount of $P_2S_5$ corresponding to the stoichiometric quantity of $P_2S_5$. This operation may be carried out at a temperature of between about 50° C. and 200° C. and preferably between 70° C. and 150° C.

The general methods for preparing the dithiophosphoric acid esters and their corresponding metal salts are described in U.S. Pat. Nos. 3,089,850, 3,102,096, 3,293,181 and 3,489,682.

The alkyl catechols or mixtures thereof which may be used to prepare the metal salts of the Formula I have the formula

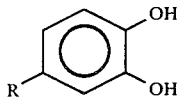

wherein R is alkyl containing 10 to 18 carbon atoms and preferably from 15 to 18 carbon atoms. Also, up to 25% by weight and preferably 15% by weight of the alkyl catechols may have the R group in a position adjacent or Ortho to one of the hydroxy groups and has the Formula IV

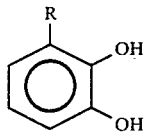

IV wherein R is defined above.

Among the alkyl catechols which may be employed are decyl catechol, undecyl catechol, dodecyl catechol, tetradecyl catechol, pentadecyl catechol, hexadecyl catechol, octadecyl catechol, and the like. Also, a mixture of alkyl catechols may be employed and preferably a mixture of $C_{15}$–$C_{18}$ alkyl catechols may be used.

The alkyl catechols of the Formula III may be prepared by reacting a branched- or straight-chained alpha-olefin containing 10 to 18 carbon atoms with pyrocatechol in the presence of a sulfonic acid catalyst at a temperature of from about 60° C. to 200° C., and preferably 125° C. to 180° C. in an essentially inert solvent at atmospheric pressure. Molar ratios of reactants may be used and preferably a 10% by weight molar excess of alphaolefin over catechol is used. Examples of the inert solvents include benzene, toluene, chlorobenzene and 250 Thinner which is a mixture of aromatics, paraffins and naphthenes.

Examples of metal compounds which may be reacted with the dithiophosphoric acid include lithium oxide, lithium hydroxide, lithium carbonate, lithium pentylate, sodium hydroxide, sodium carbonate, sodium methylate, sodium propylate, sodium phenoxide, potassium oxide, potassium hydroxide, potassium carbonate, potassium methylate, silver oxide, silver carbonate, magnesium oxide, magnesium hydroxide, magnesium carbonate, magnesium ethylate, magnesium propylate, magnesium phenoxide, calcium oxide, calcium hydroxide, calcium carbonate, calcium methylate, calcium propylate, calcium pentylate, zinc oxide, zinc hydroxide, zinc carbonate, zinc propylate, strontium oxide, strontium hydroxide, cadmium oxide, cadmium hydroxide, cadmium carbonate, cadmium ethylate, barium oxide, barium hydroxide, barium hydrate, barium carbonate, barium ethylate, barium pentylate, aluminum oxide, aluminum propylate, lead oxide, lead hydroxide, lead carbonate, tin oxide, tin butylate, cobalt oxide, cobalt hydroxide, cobalt carbonate, cobalt pentylate, nickel oxide, nickel hydroxide, nickel carbonate, molybdenum oxide, and molybdenum oxysulfide.

The overbased calcium hydrocarbyl sulfonates are materials well known in the art and are commercially available materials.

Oil soluble overbased calcium hydrocarbyl sulfonates are made by reacting a calcium base with oil-soluble hydrocarbyl sulfonic acids. Suitable oil-soluble sulfonic acids can be aliphatic or aromatic compounds. Suitable aromatic sulfonic acids are the oil-soluble petroleum sulfonic acids, commonly referred to as "mahogany acids", aryl sulfonic acids, and alkaryl sulfonic acids. Illustrative of such sulfonic acids are dilauryl benzene sulfonic acid, lauryl cetyl benzene sulfonic acid, paraffin-substituted benzene sulfonic acids, polyolefin alkylated benzene sulfonic acids, such as polybutylene alkylated benzene sulfonic acids in which the polybutylene substituents have a molecular weight of at least about 100, and preferably within the range of from about 100 to about 10,000, and polypropylene alkylated benzene sulfonic acids in which the polypropylene substituents have a molecular weight of at least about 80 and preferably within the range of from about 80 to about 10,000. Examples of other suitable sulfonic acids are diparaffin wax-substituted phenol sulfonic acids, acetyl chlorobenzene sulfonic acids, cetyl-phenol disulfide sulfonic acids, cetyl-phenol monosulfide sulfonic acids, and cetoxy capryl benzene sulfonic acids. Other suitable oil-soluble sulfonic acids are well described in the art, such as for example U.S. Pat. No. 2,616,604; U.S. Pat. No. 2,626,207; and U.S. Pat. No. 2,767,209, and others.

Some calcium salts of the above compounds have he general formula:

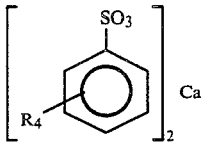

where $R_4$ is alkyl or hydroxy, chloro or bromo hydrocarbyl. In some cases the R group can be made by polymerizing $C_2$–$C_6$ olefins to a molecular weight in the range of about 80 to about 10,000, preferably about 80 to about 1,000, and then attaching said group to a benzene ring by well-known alkylation techniques. $R_4$ can be most any hydrocarbon or substituted hydrocarbon which results in an oil soluble benzene sulfonic acid or salt thereof. $R_4$ can be a low molecular weight alkyl such as isobutyl, nonyl, dodecyl, and the like; an intermediate molecular weight hydrocarbyl such as $C_{15}$–$C_{100}$ polybutene or polypropylene polymers; a higher molecular weight hydrocarbyl such as polyolefin having a number average molecular weight of 10,000, and others. $R_4$ can be substituted with groups such as chlorine, bromine, hydroxy, nitro, or sulfonic acid groups. Also, the benzene ring of the sulfonic acid may have more than one substituent alkyl, or hydroxy, halo, nitro or sulfonic acid alkyl groups.

Nonaromatic sulfonic acids are generally made by the sulfonation of most any aliphatic hydrocarbon such as alkanes, alkenes, and the like. Also, the hydrocarbyl may contain various substitutions which do not interfere with later reactions or end use. One preferred group of non-aromatic sulfonic acids is made by the sulfonation of polymers or copolymers, such as polymerized or copolymerized olefins.

The term polymer olefins as used herein refers to amorphous polymers and copolymers derived from olefinically unsaturated monomers. Such olefin monomers include olefins of the general formula $R_5CH{=}CH_2$, in which $R_5$ comprise aliphatic or cylcoaliphatic radical of from 1 to about 20 carbon atoms, for example, propene, isobutylene, butene-1, 4-methyl-1-pentene, decene-1, vinylidene norbornene, 5-methylene-2-norbornene, etc. Other olefin monomers having a plurality of double bonds may be used, in particular diolefins containing from about 4 to about 25 carbon atoms, e.g., 1,4-butadiene, 2,3-hexadiene, 1,4-pentadiene, 2-methyl-2,5-hexadiene, 1,7-octadiene, etc. These polyolefins have a number average molecular weights from about 36 to about 10,000 or higher, but preferably from about 80 to about 10,000. Of these materials, a preferred group is polypropylene or polybutylene polymers. The olefin may be a copolymer, such as an ethylene propylene copolymer or ethylene-propylene-hexadiene terpolymer, or others.

The preparation of the sulfonic acids is well known. Such sulfonic acids can be prepared by reacting the material to be sulfonated with a suitable sulfonating agent, such as concentrated sulfuric acid, fuming sulfuric acid, chlorosulfonic acid or sulfur trioxide for a period of time sufficient to effect sulfonation, and thereafter separating insoluble acid sludge from the oil soluble sulfonic acid. Overbased sulfonates are commonly made by the reaction of sulfonic acid with calcium bases such as the oxide, hydroxide, or carbonate. Suitable processes for making overbased sulfonates are described in U.S. Pat. Nos. 3,126,340; 3,492,230; 3,524,814 and 3,609,076. The carbonate overbased calcium sulfonates are preferably made from CaO and carbon dioxide in the presence of a promotor such as ethylene diamine or ammonia. However, some overbased sulfonates contain no carbonate.

The term "overbased" as used herein refers to sulfonate materials having a neutralization number or total base number (TBN) greater than about 100, preferably greater than 300, as determined by ASTM D-664 or D-2896. A preferred overbased calcium sulfonate has a TBN ranging from about 300 to 500.

One of the preferred overbased calcium hydrocarbyl sulfonates comprises overbased alkyl benzene sulfonate comprising about 4 to about 100 carbon atoms in the alkyl group, and having a total base number from about 100 to about 500 and a calcium content in the range of 3% to 18%.

The overbased calcium sulfonate is generally present in a lubricating oil at a concentration of about 0.05% to 10% by weight and preferably about 0.2 to about 2% by weight.

The salts may be added to any oil, e.g., gasoline, middle distillate fuels, industrial oils, greases, etc. but are particularly suitable as additives to oils of lubricating viscosity, especially those for use in internal combustion engines.

Preferably, the oil basestock is a lubricating oil, fractions of a mineral oil such as petroleum, either naphthenic, paraffinic or as mixed naphthenic/paraffinic base, unrefined, acid-refined, hydrotreated or solvent refined as required for the particular lubricating need. In addition, synthetic oils such as ester lubricating oils and polyalphaolefins, as well as mixtures thereof with mineral oil meeting the viscosity requirements for a particular application either with or without viscosity index improvers may also be used as basestock provided the above compound is soluble therein. The lubricating oil basestock preferably will have a viscosity in the range from about 5 to about 220 centistokes at 100° F. Suitable mineral oils include low, medium, high and very high viscosity index lubricating oils.

The amount of additive present in the composition may vary between wide limits but is suitably from 0.05 to 10% by weight with amounts of from 0.1 to 2% by weight being usual, based on the weight of the composition.

The lubricating compositions according to the invention may contain other components. Examples of such components include viscosity-index improvers including conjugated diolefin block copolymers and low molecular weight methacrylate polymers, dispersants (of the ash and/or ashless type), pour point depressants such as acrylate and methacrylate polymers, anti-oxidants, metal passivators and anti-corrosion agents. If desired, in addition to the present load-bearing additives, the lubricating composition may include other compounds having a load-bearing action.

Additive concentrates are also included within the scope of this invention. They usually include from about 90 to 10 weight percent of an oil or preferably an oil of lubricating viscosity and are normally formulated to have about 10 times the additive concentration that would be used in the finished oil composition. Typically, the concentrates contain sufficient diluent to make them easy to handle during shipping and storage. Suitable diluents for the concentrates include any inert diluent, preferably an oil of lubricating viscosity, so that the concentrate may be readily mixed with lubricating oils to prepare lubricating oil compositions.

The following examples are provided to illustrate the invention. It is understood that they are provided for the sake of illustration only and not as a limitation on the scope of the invention.

EXAMPLES

EXAMPLE 1

To a 3-liter flask, equipped with stirrer, Dean Stark trap, condensor and nitrogen inlet and outlet was charged 759 gms. of a $C_{15}$–$C_{18}$ alpha-olefin, 330 gms. of pyrocatechol, 165 gms. of a sulfonic acid cation exchange resin (polystyrene cross-linked with divinylbenzene) catalyst (Amberlyst 15 supplied by Rohm and Haas) and 240 mls. toluene. The reaction mixture was heated to 150° C. to 160° C. for about 7 hours with stirring under a nitrogen atmosphere. The reaction mixture was stripped by heating to 160° C. under vacuum (0.4 mm Hg). The product was filtered hot over super cell (SCC) to afford 908.5 gms. of $C_{15}$–$C_{18}$ alkyl substituted pyrocatechol. The product had a hydroxyl number of 259. In a similar manner, by substituting an equivalent amount of each of a $C_{12}$ alpha-olefin, a $C_{14}$ alpha-olefin and a $C_{18}$ alpha-olefin in the above procedure, the corresponding alkyl catechols are prepared.

EXAMPLE 2

To a dry, nitrogen-flushed, 5-liter flask equipped with mechanical stirrer, dropping funnel reflux condensor, and a caustic scrubber were added 277.8 gms. $P_2S_5$ and 1500 ml. toluene. To this solution was added 791.5 gms. of the $C_{15}$–$C_{18}$ alkylated catechol from Example 1 dissolved in 1500 ml. toluene over a period of 20 minutes. The reaction mixture was then heated to reflux at 110° C. for about four and a half hours. The reaction mixture was cooled to room temperature and filtered through SCC. The reaction mixture weighed 3604 gms. and contained 98.3% of the $C_{15}$–$C_{18}$ alkylated catechol dithiophosphoric acid. Infrared and NMR analysis confirmed the structure of the product. The acid number of the product was 115. The product was about 85% para subtituted and 15% ortho substituted.

In a similar manner, by substituting an equivalent amount of each of a $C_{12}$ alkyl substituted catechol, $C_{14}$ alkyl substituted catechol and a $C_{18}$ alkyl substituted catechol for the $C_{15}$–$C_{18}$ alkyl substituted catechol in the above procedure, the corresponding alkyl substituted catechol dithiophosphoric acids are obtained.

EXAMPLE 3

To a nitrogen-flushed, 5-liter flask equipped with a mechanical stirrer and reflux condenser were added 84.6 gms. of zinc oxide and 1500 mls. toluene. To the flask containing the zinc oxide was added 259 gms. of a toluene solution containing 657 gms of the $C_{15}$–$C_{18}$ alkylated catechol dithiophosphoric acid prepared in Example 2 over a period of 20 minutes. The reaction mixture was heated to reflux (110° C.) and maintained at reflux for a period of 2 hours. The reaction mixture was filtered hot through SSC. The toluene was stripped off on a rotary evaporator at 90° C. and 0.3 mm. Hg vacuum to accord 690 gms of the zinc salt of the $C_{15}$–$C_{18}$ alkylated dithiophosphoric acid. Neutron Activation analysis indicated:

% Zn=7.73; % P=5.63; and % S=9.75.

In a similar manner, by substituting an equivalent amount of each of a $C_{12}$ alkyl substituted catechol dithiophosphoric acid, a $C_{14}$ alkyl substituted catechol dithiophosphoric acid and a $C_{18}$ alkyl substituted catechol dithiophosphoric acid for the $C_{15}$–$C_{18}$ alkyl substituted catechol in the above procedure, the corresponding zinc salts are prepared.

EXAMPLE 4

Formulated oils containing the additives shown in Table I were prepared and tested in a Sequence V-D Test method Phase 9-L (according to candidate test for ASTM). The results of the tests are shown in Table II. This procedure utilizes a Ford 2.3 liter four cylinder engine. The test method simulates a type of severe field test service characterized by a combination of low speed, low temperature "stop and go" city driving and moderate turnpike operation. The effectiveness of the additives in the oil is measured in terms of the protection provided against valve train wear.

TABLE I

TEST OIL FORMULATIONS
(mmoles/kg - except where noted)

| COMPONENTS | FORMULATIONS A | B | C | D | E |
|---|---|---|---|---|---|
| Zinc dithiophosphate from sec-butanol and methylisobutylcarbinol | 8.1 | — | — | — | — |
| Zinc di(2-ethylhexyl) dithiophosphate | — | — | — | 9 | 9 |
| Zinc dithiophosphate from $C_{12}$ alkylphenol | — | 8.1 | — | — | — |
| Zinc dithiophosphate from $C_{15-18}$ alkylcatechol of Ex. 3 | — | — | 8.1 | — | 9 |
| Zinc dithiophosphate from isopropanol and methyl isobutyl carbinol | — | — | — | 9 | — |
| Polyisobutenyl succinimide[1] | 3.5% | 3.5% | 3.5% | 7.0% | 7.0% |
| 300 AV overbased Calcium Alkylbenzene Sulfonate | 30 | 30 | 30 | 20.4 | 20.4 |
| Neutral Calcium Sulfonate | — | — | — | 20.4 | 20.4 |
| Overbased calcium polypropylene phenate (9.25% calcium) | 20 | 20 | 20 | 81.9 | 81.9 |
| Polymethylacrylate VI improver | 8.5% | 8.5% | 8.5% | — | — |
| Hydrogenated block copolymer of styrene and isoprene | — | — | — | 20% | 20% |

[1]The succinimide was prepared by reacting polyisobutenyl succinic anhydride wherein the number average molecular weight of the polyisobutenyl is about 950 and triethylenetetramine.

TABLE II

RESULTS
SEQUENCE V-D TEST

| Formulation | Cam Lobe Wear × $10^{-3}$ SF Spec. Max. (2.5) | SF Spec. Avg. (1.0) | Follower Weight Loss, mg Max. | Ave. |
|---|---|---|---|---|
| A | 6.70 | 3.90 | 295 | 135 |
| B | 7.9 | 4.8 | 234 | 44 |
| C | 0.8 | 0.6 | 6 | 2 |
| D | 3.7 | 1.5 | 166 | 59 |
| E | 0.7 | 1.2 | 155 | 30 |

As indicated from the results in Table II the oil formulations C and E, containing the zinc dithiophosphate prepared from the alkyl catechol of Example 3 gave superior wear performance relative to formulations A, B and D, containing zinc alkyl and phenyl dithiophosphates.

What is claimed is:

1. In a lubricating oil composition containing an overbased calcium hydrocarbyl sulfonate, the improvement wherein said lubricating oil composition additionally comprises an effective amount to reduce wear of a metal salt of an alkyl catechol dithiophosphoric acid ester of the formula:

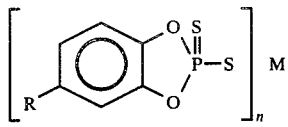

wherein R is alkyl containing 10 to 18 carbon atoms, or mixtures thereof, M is an alkali or alkaline earth metal or transition metal and n corresponds to the valence of the metal M.

2. The composition of claim 1 wherein the metal M is zinc.

3. The compound of claim 1 wherein R is alkyl of 15 to 18 carbon atoms or mixtures thereof.

4. The composition of claim 1 wherein R is alkyl having a range of from 15 to 18 carbon atoms, M is zinc and n is 2.

5. The composition of claim 1 wherein the metal salt of an alkyl catechol dithiophosphoric acid ester is present from about 0.05% to 10% by weight based on the total weight of the lubricating oil composition.

6. A composition comprising a combination of (1) a metal salt of an alkyl catechol dithiophosphoric acid ester of the formula:

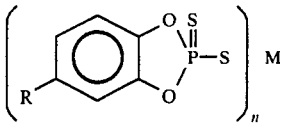

wherein R is alkyl containing 10 to 18 carbon atoms, or mixtures thereof, M is an alkali or alkaline earth metal or transition metal and n corresponds to the valence of the metal M; and (2) an overbased calcium hydrocarbyl sulfonate, wherein the weight ratio of component (1) and the overbased calcium salt of component (2) is in the range sufficient to supply from 0.05 to 10% by weight of component (1) and from 0.05 to 10% by weight of component (2) when the additive combination is dissolved in an oil of lubricating viscosity.

7. The composition of claim 6 wherein in component (1) of said combination the metal is zinc.

8. The composition of claim 6 wherein in component (1) of said combination, R is alkyl of 15 to 18 carbon atoms or mixtures thereof.

9. The composition of claim 6 wherein in component (1) of said combination, R is alkyl having a range of from 15 to 18 carbon atoms, M is zinc and n is 2.

* * * * *